United States Patent [19]

McKean

[11] Patent Number: 4,476,749

[45] Date of Patent: Oct. 16, 1984

[54] AUTOMATIC STUD DRIVER

[75] Inventor: John A. McKean, Fairview, Pa.

[73] Assignee: Titan Tool Company, Fairview, Pa.

[21] Appl. No.: 579,288

[22] Filed: Feb. 14, 1984

Related U.S. Application Data

[63] Continuation of Ser. No. 405,365, Aug. 5, 1982, abandoned, which is a continuation of Ser. No. 179,444, Aug. 19, 1980, abandoned.

[51] Int. Cl.[3] ..... B25B 19/00

[52] U.S. Cl. ..... 81/53.2

[58] Field of Search ..... 81/53.2

[56] References Cited

U.S. PATENT DOCUMENTS

| | | | |
|---|---|---|---|
| 603,825 | 5/1898 | Barber . | |
| 1,583,554 | 5/1926 | Hoover . | |
| 1,607,804 | 11/1926 | Snyder . | |
| 1,788,679 | 1/1931 | Leiter | 81/53.2 |
| 1,807,265 | 5/1931 | Walker . | |
| 1,817,049 | 8/1931 | Weil . | |
| 1,825,876 | 10/1931 | Leiter . | |
| 1,968,058 | 7/1934 | Senkewitz . | |
| 2,069,527 | 2/1937 | Kirkland . | |
| 2,216,557 | 10/1940 | McKean . | |
| 2,251,491 | 8/1941 | Lozen . | |
| 2,257,089 | 9/1941 | Caminez . | |
| 2,492,307 | 12/1949 | McKean | 81/53.2 |
| 2,516,288 | 7/1950 | Bagoon | 81/53.2 |
| 2,531,456 | 11/1950 | McKean | 81/53.2 |
| 2,628,105 | 11/1950 | McKean . | |
| 2,743,639 | 5/1956 | Lynch | 81/53.2 |
| 3,443,818 | 7/1967 | Fauth . | |
| 3,672,692 | 6/1972 | Fauth . | |
| 3,793,912 | 2/1974 | Bilz | 81/53.2 |

FOREIGN PATENT DOCUMENTS 1334909 10/1973 United Kingdom .

OTHER PUBLICATIONS

Titan Tools No. 100 Series, Automatic Self-Opening Stud Driver.

*Primary Examiner*—James L. Jones, Jr.
*Attorney, Agent, or Firm*—Parkhurst & Oliff

[57] ABSTRACT

A stud driver for the insertion of studs into a workpiece. The stud driver automatically grasps the stud once the stud is inserted into the stud driver. Once the stud is inserted into the workpiece, the stud driver automatically releases the stud. The stud driver employs a set of jaws to grasp the stud. The jaws, which are biased open by a plunger means, are enclosed with a carriage. In the peripheral wall of the carriage, two sets of balls are held. The balls prevent the jaws from sliding out of the carriage and from rotating in the carriage. The carriage is driven by a driven head which is connected to the driving means. The carriage and driven head are held in an uncomplicated hollow cylinder which is the body.

5 Claims, 5 Drawing Figures

A
B
C
10
11
12
13
14
15
16
20
30
31
32
33
34
40
41
42
43
44
45
46
47
48
49
50
51
52
53
54
55
56
57
58
58A
59
60
61
62
63
64
65
66
70
71
72
73
74
75
76
78
80
81

AUTOMATIC STUD DRIVER

This is a continuation of application Ser. No. 405,365 filed Aug. 5, 1982, now abandoned which in turn is a continuation of application Ser. No. 179,444 filed Aug. 19, 1980, now abandoned.

BACKGROUND OF THE INVENTION

In the prior art, automatic stud drivers have been complicated devices in which a set of jaws were clamped onto the stud and then, while the jaws firmly and nonrotatably hold the stud, the stud was inserted into the workpiece. Once the stud was fully inserted in the workpiece, the stud driver automatically released the stud from the jaws and allowed the stud driver to be pulled away from the stud.

U.S. Pat. No. 2,743,639 to Lynch discloses a stud setter for automatically inserting studs. The stud setter disclosed in Lynch U.S. Pat. No. 2,743,634 is a very complicated device comprising numerous concentric cylinders, numerous metal balls within the cylinders, and a set of jaws in the middle of all of the cylinders. Each of the balls within the concentric cylinders lies within holes in one of the cylinders and slide in and out of grooves in the other cylinders and grooves in the jaws. The various grooves in the cylinders and jaws caused the manufacture and assembly of the stud setter to be extremely difficult.

OBJECTS OF THE INVENTION

The principal objects of the present invention are to provide an automatic stud setter which can be easily and quickly assembled with a minimal number of tools, which is easier to manufacture than prior automatic stud setters, and which is of smaller maximum outside diameter than prior automatic stud setters for use in work areas where larger prior automatic stud setters could not be utilized.

DETAILED DESCRIPTION OF THE INVENTION

Figures 1, 2, 3, 4, 5:
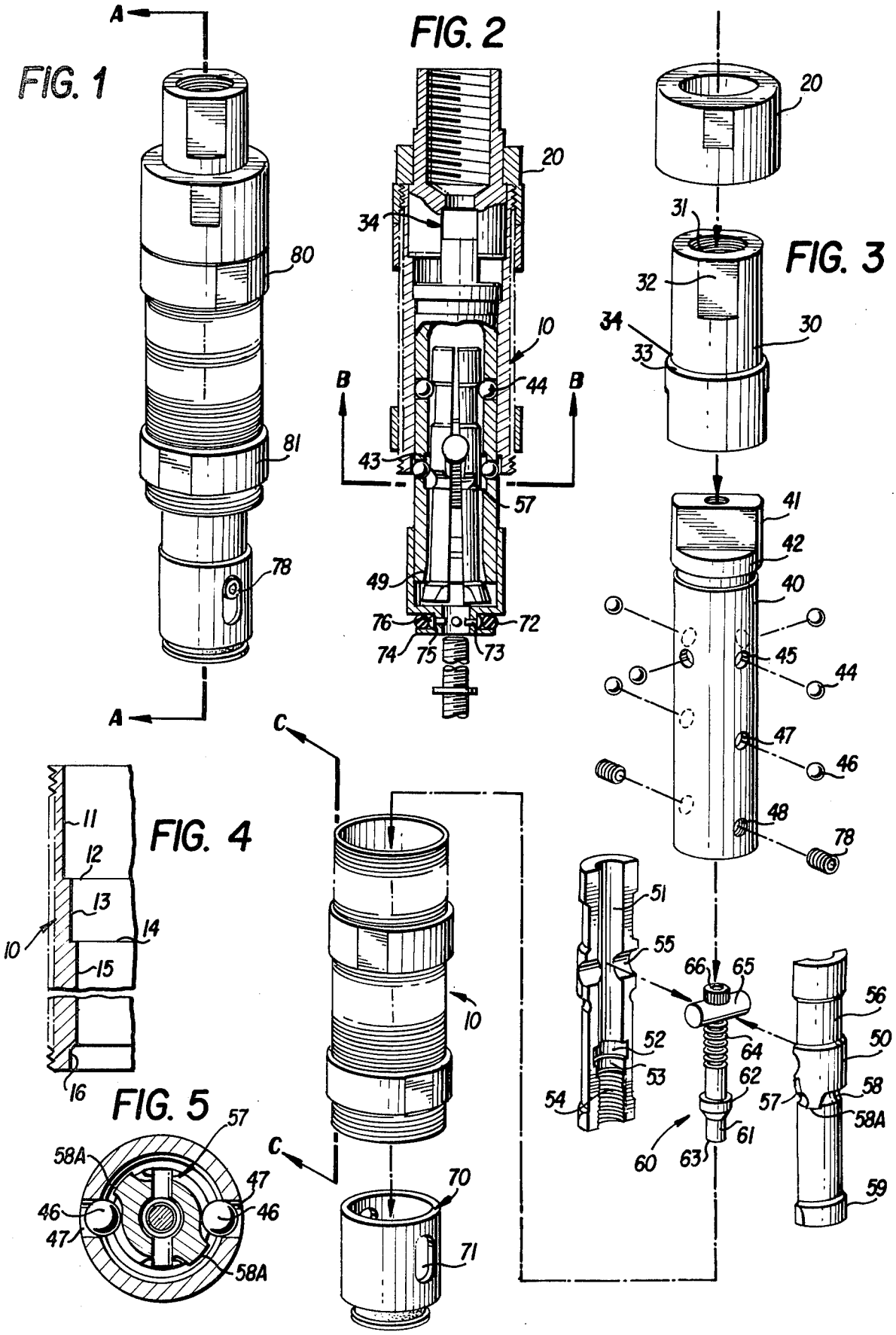
FIG. 1 is a perspective view of the stud driver.
FIG. 2 is a partially cut away view along line A—A of FIG. 1, and in FIG. 2 the jaws, the plunging means, and the top of the carriage are not cut away.
FIG. 3 is an exploded view of the stud driver.
FIG. 4 shows one half of a cross-sectional view of the body along the line C—C of FIG. 3.
FIG. 5 is a cross-sectional view along line B—B of FIG. 2.

The automatic stud driver according to the present invention comprises a body 10; a collar 20; a driven head 30; a carriage 40; two sets of balls in the carriage (four retaining balls 44 and two latching balls 46); a set of jaws 50; a plunger 60; and a stud pick-up and aligning means 70. As shown in FIG. 2, the assembled stud driver has three concentric cylinders; the body 10, the carriage 40 which is inside the body 10, and the driven head 30 also in the body 10.

The driven head 30 and the carriage 40 are secured inside of the body 10 by the collar 20, which screws onto the exterior threads of the body 10. The driven head 30 and the carriage 40 are prevented from sliding through body 10 by the head ledge 12 and the carriage ledge 14, respectively both on the body 10 (FIG. 4).

The carriage ledge 14 is far enough down into body 10 so as to allow the carriage 40 a limited range of sliding between the bottom of the driven head 30 and the carriage ledge 14.

In operation, the driven head 30 is attached to a driving means. The driving means supplies rotary and reciprocal motion to the stud driver. The driven head 30 is also coupled to the carriage 40 so as to transfer the power and motion of the driving means to the carriage 40 but still allow the carriage 40 to slide in the body 10.

The carriage 40 is the envelope for the assembly of jaws 50. The jaws 50 grip the stud by a grooved threaded section 54 whose threads match those of the studs. The jaws 50 are assembled about the plunger means 60 forming a cylindrical shape which is held together by the hollow inside surface of the carriage 40 (FIG. 2). A hole is formed by the grooved threaded section 54 in the bottom of the assembly of jaws 50. It is into this hole that the stud is inserted to be grasped by the jaws 50.

The assembly and disassembly of the stud driver has been greatly simplified in the present invention by the novel body, carriage, jaws, and stud pick-up and aligning means. The jaws 50 are held around the plunger means 60 and then inserted into the carriage 40. Then the retaining balls 44 and the latching balls 46 are placed into the retaining ball holes 45 and latching ball holes 47 in the carriage 40. Before the carriage 40 is dropped into the body 10, either the jaws 50 must be closed to line up the latching ball groove 58 with the latching ball holes 47 or the diametrically opposed cuts 57 in the side of the jaws 50 which forms grooves between the two jaws must be lined up with the latching holes 47, so as to provide a recess between the jaws 50 for the latching balls 46 as they slide past the surface 15 on the body 10 and allow the carriage 40 to slide into the body 10. Once the carriage 40 is in the body 10, the driven head 30 is slid into the body 10 so that the post 41 on the carriage 40 slides into the slot 34 in the driven head 30. The collar 20 is then slid over the driven head 30 and screwed onto the body 10, and the collet 80 (FIG. 1) is tightened up against the collar 20 to lock the collar 20 on the body 10 to complete the assembly of the stud driver. The collet 81 can be utilized to secure accessories, such as a dust cover or a trip gauge, to the tool.

Optionally, the stud pick-up and aligning means 70 may be slid onto the end of the carriage 40, the slots 71 in the stud pick-up and aligning means are aligned with the set screw holes 48 in the carriage 40, and the set screws 78 are inserted into the carriage 40.

To disassemble the stud driver, the reverse process is used. To remove the jaws 50 from the carriage 40 once the carriage 40 is out of the body 10, the jaws 50 need to be closed which requires a stud to be inserted into the jaws.

The assembly and disassembly of the stud driver requires only a stud, a hex end wrench for the set screws 78 if the optional stud pick-up and aligning means 70 is utilized, and a set of wrenches for the collar 20, collet 80 and optional collet 81, and driven head 30. The advantages of such a simple to assemble stud driver are enormous in saving time in maintaining the stud driver.

In the stud setter, the means to grip the stud are the jaws 50. On the inside planar surface of each jaw 50 is a semicircular groove 51 extending the length of the jaw. The lower section of the groove 51 is threaded to match the threads on the stud. Thus, when the jaws are closed onto the stud, the threaded section 54 of the jaws 50 can grip the stud without damaging any of the threads on the stud.

Fitted into the upper section of the groove 51 above the threaded section 54 is the plunger means 60. The plunger means 60 is held in the the groove 51 of the jaws 50 by a pivot cylinder 65. The pivot cylinder 65 is slidably mounted on a threaded shaft 66 of the plunger means. The pivot cylinder 65 fits in pivot grooves 55 of the jaws 50. The pivot grooves 55 are perpendicular to the lengthwise groove 51. The plunger means 60 biases the lower portion of the jaws 50 outwards to allow the jaws to slide over the stud. The jaws 50 are opened by an annulus 62 on the plunger means 60 which is biased towards the opening groove 53 of the groove 51 in the jaws and away from the closing groove 52. Since the closing groove 52 has a larger radius than does the annulus 62, the jaws can be closed while annulus 62 is in the closing groove 52 but since the annulus 62 is biased towards the opening groove 53, which has a smaller radius than annulus 62, the lower section of the jaws are forced apart. The spreading out of the jaws 50 disengages the threaded section 54 from the stud and thus releases the stud. The lower section of the annulus 62 is tapered inward so as to allow the annulus 62 to smoothly slide from the closing groove 52 to the opening groove 53.

The annulus 62 along with the entire lower half of the plunger means 60 is biased downward in the jaws 50 towards the closing groove 53 by a helical spring 64. The helical spring 64 pushes up against the pivot cylinder 65, which is slidably mounted on the threaded shaft 66. The pivot cylinder 65 is prevented from sliding off the threaded shaft 66 by the hex end head on the threaded shaft 66. The bottom 63 of the plunger means 60 extends into the threaded section 54 of the jaws. As the stud is inserted into the jaws 50, the end of the stud presses up against the bottom 63 of the plunger means 60 and, by overcoming the biasing force, forces the plunger means 60, including the annulus 62, upwards in the groove 51. The annulus 62 slides into the closing groove 52 and allows the jaws to close onto the stud.

The assembly of the jaws 50 and the plunger means 60 is enclosed in the carriage 40. The carriage 40 is a hollow cylinder with a closed top end 42. Although the jaws and plunger assembly can easily be slid into the carriage, once inserted, the jaws 50 cannot unintentionally slide out. The three means which prevent the jaws 50 from sliding out of the carriage are: the retaining balls 44 which ride in the peripheral wall of the carriage 40, the latching balls 46 which also ride in the peripheral wall of the carriage 40, and a locking groove 43 (FIG. 2) around the inside surface of the carriage 40. The locking groove 43, which forms a circle perpendicular to the axis of the carriage 40 around the inside surface of the carriage 40, prevents the open jaws 50 from sliding out of the carriage 40 by acting as a stop for diametrically opposed bridges 58A on the jaws 50. When the carriage 40 is in the body 10, the retaining balls 44 prevent the jaws from sliding completely out of the body 10, regardless of whether the jaws 50 are closed or not.

The retaining balls 44 are held in the peripheral wall of the carriage 40 in the retaining ball holes 45. The retaining balls 44 have a diameter larger than the thickness of the peripheral wall of the carriage 40. Thus, when the carriage 40 is in the body 10 which brings the wall of the carriage 40 flush with inner surface 15 of the body 10, the retaining balls 44 protrude past the inside surface of the peripheral wall of the carriage 40 (FIG. 2). The jaws 50, which fit snugly in the carriage 40, compete for space inside the carriage with the retaining balls 44. The only section of the jaws assembly which is thin enough to fit between the protruding retaining balls 44 is the retaining ball groove 56. The retaining ball groove 56 is wide enough to allow the jaws 50 a limited range of sliding movement up and down within the carriage 40. Within this range, the jaws 50 can slide out of the carriage 40 until the bridges 58A engage with the groove 43 of the carriage 40 and the jaws 50 can slide into the carriage 40 until the bottom of the jaws 50 are approximately flush with the bottom of the carriage 40.

The jaws 50 are also held within the carriage by the latching balls 46. The latching balls 46 are held in the peripheral wall of the carriage 40 in the latching ball holes 47. As with the retaining balls 44, the latching balls 46 have a diameter larger than the thickness of the peripheral wall of the carriage 40. Thus, when the carriage 40 is slid up into the body 10 such that the top 42 of the carriage 40 is up against the bottom of the driven head 30 bringing the latching ball holes 47 up next to and flush with the inner surface 15 of the body 10, the latching balls 46 are forced to extend past the inner surface of the peripheral wall of the carriage 40. Only the latching ball groove 58 can fit between the protruding latching balls 46. The latching ball groove 58 cannot slide past the protruding latching balls 46 because of the thicker portion of the jaws 50 just above the latching ball groove 58. Consequently, the jaws 50 cannot slide out of the carriage 40 when the latching balls 46 are forced into the latching ball groove 58.

All the means which prevent the jaws 50 from sliding completely out of the carriage 40 allows the jaws 50 a limited amount of sliding within the carriage 40. That limited amount of sliding of the jaws 50 in and out of the carriage is the means by which the jaws are closed and allowed to open. When the jaws have slid partially out of the carriage, as in FIG. 2, the jaws 50 are biased open by the plunger means 60. When a stud is inserted into the jaws 50, the stud pushes the jaws 50 up into the carriage 40 which brings the closing lip 59 on the jaws 50 into engagement with the tapered surface 49 on the carriage 40. Engagement of the closing tips 59 and the tapered surface 49 causes the lower half of the jaws 50 to come closer and closer together as the jaws 50 are slid further and further up into the carriage 40 until finally the jaws are closed firmly onto the stud which prevents the closing lips 59 from sliding any further up against tapered surface 49. Once this happens, the jaws 50 are fully closed onto the stud.

The insertion of the stud into the jaws 50 also forces the carriage 40 to slide up in the body 10 against the bottom of the driven head 30. Once the carriage is slid up in the body 10, the latching ball holes 47 are adjacent to the inner surface 15 of the body, which forces the latching balls 46 to protrude past the inner surface of the peripheral wall of the carriage 40 and into the latching ball groove 58. Since the latching ball groove 58 is bridged at 58A, the jaws can only rotate in the carriage 40 until the latching balls 46 are abutted with the side of the bridges 58A. Thus, when the stud is being spun into the workpiece, the stud cannot force the jaws 50 to spin around in the carriage 40.

Power and motion is imparted to the stud driver through the driven head 30. The driven head 30 is rotatably held into the body 10 by the collar 20 by engaging with the lip 33 on the driven head 30. Through the bottom of the driven head 30 is the slot 34 perpendicular to the axis of the driven head 30. This slot 34 slidably but nonrotatably engages with the post 41 on the top of the carriage 40. The slot 34 and post 41 engagement allows the carriage 40 to slide up and down within body 10 but still be rotatably coupled with the driven head 30. The top end 31 of the driven head 30 is attached to some driving means, such as a drill press, which imparts reciprocal and rotary motion to the stud driver.

The collar 20 holds the driven head 30 in the body 10. The collar 20 screws on to the top end of the body 10. The collar 20 engages with lip 33 and bearing surface 35 on the driven head 30. The collar 20 holds the driven head 30 coaxial to the body by the engagement of the bearing surface 35 and a similar bearing surface on the inside of the collar.

Planar surfaces 32 have been cut out of the upper cylindrical surface of the driven head 30 so that a wrench can be used to tighten the driven head 30 onto the driving means. A similar planar surface has been cut out of the outer cylindrical surface of the collar 20 to also provide a grip for a wrench to tighten the collar 20 onto the body 10. Collet 80 has a planar surface for a wrench and is tightened up against the collar 20 as a locking mechanism to prevent the collar 20 from being shaken loose during operation of the stud driver.

The optional stud pick-up and aligning means 70 picks up and holds the stud until the stud is to be inserted into the jaws. The stud pick-up and aligning means 70 initially aligns the stud prior to its insertion into the jaws 50 so that the stud is coaxial with the jaws 50.

The bottom of the stud pick-up and aligning means 70 has an inverted table top section 74 having four holes 75 symmetrically disposed about its side, each of which holds one of a plurality of pins 73. The pins 73 each have a head 76 which prevents them from sliding through the holes 75. The pins 73 are biased inwards towards the axis of stud pick-up and aligning means 70 by a resilient O-ring 72. The pins 73 engage the end of the stud when the stud is inserted into the stud driver and position the stud towards the center of the jaws 50. The pins 73 do not firmly grasp the stud and thus allow the stud to slide past and rotate in the pins 73. The stud pick-up and aligning means 70 is held onto the carriage 40 by two diametrically opposed set screws 78 which are enclosed by corresponding slots 71 in the peripheral wall of the stud pick-up and aligning means 70. The set screws 78 are set in set screw holes 48 in the carriage 40 and protrude out from the peripheral wall of the carriage 40. The set screws 78 are inserted in the carriage 40 after the stud pick-up and aligning means 70 has been slid onto the end of the carriage 40. The slot 71 and set screw arrangement permits the stud pick-up and aligning means 70 to slide up and down a limited distance relative to the carriage 40.

In operation, the assembled stud driver is attached by the driven head 30 to the driving means. In the beginning of the sequence (as shown in FIG. 2), the jaws 50 are open and partially out of the carriage 40 which has slid down away from the driven head 30 in the body 10 to rest on the carriage ledge 14 in the body 10. When the stud driver has the optional stud pick-up and aligning means 70, the stud is inserted into the stud driver, by first passing through the stud pick-up and aligning means 70, which picks up the stud and holds the studs until the stud is to be inserted into the jaws. Usually the stud is held in the stud pick-up and aligning means 70 until the stud is brought into contact with the threaded stud hole, at which time the stud is pushed up into the jaws as the stud pick-up and aligning means 70 aligns the stud coaxial to the open jaws 50. As the stud is further inserted into the stud driver, the end of the stud abuts the bottom 63 of the plunger means 60. Once the stud overcomes the biasing force of the helical spring 64, the stud forces the annulus 62 to slide up into the jaws 50 from the opening groove 53 of the jaws into the closing groove 52. Once the annulus 62 of the plunger means 60 abuts up against the top of the closing groove 52 of the jaws 50, the upward movement of the stud forces the plunger means and jaws assembly up into the carrige. As the jaws 50 slide up into the carriage 40, the closing lips 59 of the jaws slide against the tapered inner surface 49 of the carriage 40 and force the threaded section 54 of the jaws 50 to firmly close onto the stud. The upward movement of the stud will also force the carriage 40 to slide up into the body 10 until the top 42 of the carriage 40 is flush against the bottom of the driven head 30, thus bringing the latching ball holes 47 up flush with inner surface 15 of the body 10 and causing the latching balls 46 to protrude inwards past the inner surface of the peripheral wall of the carriage 40 and into the latching groove 58 of the jaws 50.

When the stud driver first starts rotating the stud down into the workpiece, the stud resists being screwed into the workpiece and rotates in the threaded section 54 of the jaws 50. However, as the stud rotates in the threaded section 54, it screws further and further up into the jaws 50 until it finally abuts the bottom 63 of the plunger means 60. The plunger bottom 63 is prevented from going any further up into the jaws 50 by the annulus 62, which is abutted up against the top of the closing groove 52. Once the stud is up against the bottom 63, the stud is prevented from rotating any further up into the jaws 50. At that point, the stud will then cause the jaws 50 to rotate within the cylinder 40 but the jaws can only rotate through a limited arc since the latching groove 58 in which the latching balls 46 ride is bridged at 58A. Once the stud is stopped from rotating in the jaws 50 by the plunger bottom 63 and the jaws 50 are stopped from rotating in the carriage 40 by the latching balls 46 binding against the bridges 58A, the stud is forced to rotate down into the workpiece.

After the stud is fully inserted into the workpiece, the stud driver, which is still grasping the stud, is pulled up away from the stud. The stud pulls the carriage 40 down away from the driven head 30 and into the body, which brings the latching ball holes 47 in the carriage 40 adjacent the larger diameter inner surface 16 of the body 10 and allows the latching balls 46 to come out away from the jaws 50 in the latching ball holes 47. Once the latching balls 46 have moved outwards in the wall of the carriage 40 out of the latching ball groove 58, the jaws 50 can be pulled by the stud down out of the carriage 40 until the closing lips 59 are disengaged from the tapered surface 49 of the carriage 40, which allows the plunger means 60 to bias open the jaws 50 and allow the stud to become disengaged from the stud driver, thus completing the operation of inserting the stud into the workpiece.

What is claimed is:

1. A stud driving device comprising:

a cylindrical hollow body having a longitudinal axis, said body having a stepped inner peripheral surface, an inside diameter of a first portion of said stepped inner peripheral surface being greater than an inside diameter of a second portion of said inner peripheral surface;

a rotatably and reciprocally driven head;

a cylindrical carriage with a peripheral wall, said carriage being partially inside of said body and being axially slidable and rotatable with respect to said body, said carriage being rotatably driven by said driven head;

a plurality of jaws enclosed by said carriage, said jaws having a stud gripping means, said plurality of jaws being arranged in a cylindrical shape of substantially the same diameter as the inside diameter of the peripheral wall of said carriage, each of said jaws being provided with a first groove oriented in a plane generally perpendicular to the longitudinal axis of the body, the first groove on one jaw being adjacent to a similar first groove on another jaw;

means to open and close said jaws on a stud, said plurality of jaws having an open and a closed position;

a plurality of latching balls held in the peripheral wall of said carriage in contact with the jaws and one of said first and second portions of said inner peripheral surface of said body, said latching balls extending past the inside surface of said peripheral wall of said carriage when said latching balls are in contact with said second portion of said inner peripheral surface of said body, said carriage being axially slidable from said first portion to said second portion of said inner peripheral surface of said body with said jaws in a closed position when said latching balls align with said first groove on said jaws;

the improvement comprising a cut on a side edge of each of said jaws, said cut being oriented generally parallel to said longitudinal axis of said body and being adjacent a similar cut on another of said jaws, said pair of cuts defining an axially oriented second groove between said jaws for holding one of said latching balls, each cut being of a size and axial length so that, when one of said latching balls is located within said second groove, the radially outermost portion of said ball is located at or within the wall of the carriage, thereby allowing the carriage to be axially inserted within said body and move from said first portion to said second portion of said stepped inner peripheral surface of said body with said jaws in the open position.

2. An automatic stud driving tool comprising:

a hollow body, a carriage disposed within said body and having a longitudinal axis, the carriage provided with a cavity extending therethrough along said axis;

a first set of latching balls held in a peripheral wall of said cavity;

a pair of opposed jaws, each having a bridging portion, said jaws provided partially within said cavity and capable of rotating about and sliding along the axis of said carriage as a unit, said bridging portion blocking rotation of said jaws with respect to said carriage when one of said latching balls abuts said bridging portion, means for moving said jaws about a pivot axis to at least two positions relative to each other, an open and a closed position, with the bridging portions on the jaws being further apart at the open position than the closed position;

the pair of jaws being provided with gripping means for gripping a stud in a non-rotatable manner when said jaws are in said closed position, and for releasing said stud when said jaws are in said open position;

preventing means for positively preventing the jaws from moving from the open position to the closed position unless a stud is engaged with said gripping means;

holding means for preventing the removal of the jaws from the carriage when said jaws are in said open position, said holding means comprising selectively interengaging surfaces integrally formed on the surface of said jaws and on the surface of said cavity, said surfaces being located between said pivot axis and said gripping means so that when said jaws are closed, said surfaces disengage and move axially past each other, but when said jaws are open, said surfaces abut one another and thereby prevent said jaws from being removed from said carriage; and means to rotate the carriage to thereby rotate the jaws, to in turn rotate the stud into a work piece.

3. An automatic stud driving tool as in claim 2, further comprising a latching groove running circumferentially around the outside surface of each jaw, the latching balls extending partially into the carriage cavity, and therefore into the latching grooves in at least one position of said cavity with respect to said body, such that the jaws are capable of rotating with respect to the carriage when the latching balls extend into the latching grooves, each of said latching grooves being bridged by the bridging portion on the exterior of the jaw so that the rotation of the jaws is stopped when the latching balls contact the bridging portion, wherein the bridging portion also comprises one of the interengaging surfaces.

4. An automatic stud driving tool as in claim 2, wherein the carriage has retaining ball apertures therethrough, the jaws have retaining ball grooves, and a second set of retaining balls are located in the retaining ball apertures such that they partially extend from the retaining ball apertures into the retaining ball grooves to thereby hold the jaws within the carriage when the jaws are in the closed position.

5. An automatic stud driving tool as in claim 2, wherein a stud pick-up and aligning means is coaxially mounted with said carriage; said carriage having a plurality of circumferentially symetrically disposed apertures on a lower portion thereof; said stud pick-up and aligning means further comprising:

second gripping means located at a lower end of said pick-up and aligning means to loosely grip a stud such that said stud is coaxial with said jaws;

a peripheral wall above said second gripping means telescoping over said lower portion of said carriage;

a plurality of longitudinally extending slots in said peripheral wall disposed so as to overlie said apertures in said carriage; and stopping means extending through said slots and into said apertures, whereby said pick-up and aligning means is capable of sliding relative to said stopping means.

* * * * *